US005161719A

United States Patent [19]

Otteson et al.

[11] Patent Number: 5,161,719

[45] Date of Patent: Nov. 10, 1992

[54] DEVICE FOR SUPPORTING AND SHAPING PLIABLE BALL CAPS

[76] Inventors: Tommy R. Otteson, P.O. Box 1224, 57 Ketten Rd.; Danny V. Otteson, P.O. Box 1814, Space 6, Jensen Ct., both of Tonopah, Nev. 89049

[21] Appl. No.: 696,186

[22] Filed: May 3, 1991

[51] Int. Cl.[5] ..... A42C 1/00

[52] U.S. Cl. ..... 223/24; 223/84; 223/66; 2/185 B; 2/185 C

[58] Field of Search ..... 223/24, 66, 57, 84; 2/209.5, 185 B, 185 C, 180

[56] References Cited

U.S. PATENT DOCUMENTS

| | | | |
|---|---|---|---|
| 2,490,508 | 12/1949 | Delgatto | 223/84 X |
| 2,491,309 | 12/1949 | Hanson | 223/84 X |
| 2,740,567 | 4/1956 | Kaufman | 223/84 |
| 2,812,887 | 11/1957 | Palinkas | 223/24 |
| 3,036,698 | 5/1962 | Gronemeyer | 223/84 X |
| 3,161,293 | 12/1964 | Sander | 223/24 X |
| 3,417,407 | 12/1968 | Divine | 2/180 |
| 3,480,969 | 12/1969 | Miller | 2/180 |
| 3,713,566 | 1/1973 | Perez Perez | 223/66 |
| 3,746,221 | 7/1973 | Grifoni | 223/66 |
| 4,637,077 | 1/1987 | Henschel | 2/185 |
| 4,805,782 | 9/1989 | Hale | 211/30 |
| 4,858,247 | 11/1989 | Hooser | 2/185 |
| 5,012,531 | 5/1991 | Schoonover | 2/185 B |

FOREIGN PATENT DOCUMENTS

| | | | |
|---|---|---|---|
| 473319 | 3/1933 | Denmark | 223/24 |
| 599771 | 6/1934 | Fed. Rep. of Germany | 223/66 |
| 563005 | 3/1957 | Italy | 223/66 |

*Primary Examiner*—Werner H. Schroeder
*Assistant Examiner*—Bibhu Mohanty

[57] ABSTRACT

A cap shaping and drying device having a mesh (16) covered support frame (12) conforming to the shape of the crown of ball caps (42). Also consisting of a conformable interconnected frame projection (14) used to support and shape the bill of ball caps (44). Device adequately and efficiently allows washed or wetted ball caps to regain their original shape and style during the drying phase.

3 Claims, 3 Drawing Sheets

DEVICE FOR SUPPORTING AND SHAPING PLIABLE BALL CAPS

BACKGROUND AND DESCRIPTION OF PRIOR ART

The cap shaper herewith described is designed to provide the cap owner with a device for shaping, styling, and drying washed sports or ball type caps. This device causes the cap to regain its original prewashed shape.

Cap owners are washing and laundering their ball caps now when they become in need of cleaning. Also the cost and unique designs of ball caps presently available is persuading cap owners to wash and reuse their ball caps on a regular basis.

After a cap has been washed or laundered the cap naturally becomes wet and limp loosing its original shape and style. If left to dry without some form of support, the ball cap will deform and dry flat and wrinkled. Depending on the type of material, the ball cap may also shrink. Circular stiffening materials built into ball caps experience substantial loss of shape during such cleaning operations.

Heretofore the cap owner has had to use any object of the appropriate size and shape to provide this support. Commonly used objects now found in use includes jars, jugs, and coffee cans.

The drawbacks of these objects are numerous. These objects are all solid causing the ambient air to contact only the outer surface of the ball cap, slowing drying time. Also, dried over these objects causes the ball cap to dry in the shape of the object, rather than its original shape and style.

Without proper support the visor or bill of the ball cap will also loose its shape during this phase.

As is to be expected given the popularity of ball caps the prior art is well known. Unfortunately none of the objects mentioned or prior art found addresses all of these problems entirely and adequately.

For example, U.S. Pat. No. 2,681,451, which issued to E. Lipechutz on Jun. 22, 1954, discloses a cap reinforcment structure comprising a top and bottom ring interconnected by support members.

U.S. Pat. No. 4,637,077, which issued to E. Henschel on Jan. 10, 1987, comprises an insert to hold the forward portion of the crown of a ball cap allowing the rear of the ball cap to be folded. This allows the frontal portion of the ball cap to hold its shape while the rest is folded to reduce area during shipping.

U.S. Pat. No. 4,805,782, which issued to Everret and Violet Hale on Feb. 21, 1989, discloses a cap shaping and drying apparatus. This device uses a support unit to hold the frontal portion of the crown of the ball cap and a capturing unit to engage and hold the bill of the ball cap.

U.S. Pat. No. 4,858,247, which issued to D. Hooser on Aug. 22, 1989, comprises a circular plastic adjustable ring with a upwardly extending section designed to support and shape the frontal portion of the crown of ball caps.

While these are all functional for their intended purpose, they all fall short in supporting and shaping the "entire" ball cap.

None of the above mentioned patents support or shape the entire crown, inparticularly the entire top portion front to back, of the ball cap. Although U.S. Pat. Nos. 2,681,451 and 4,805,782 have a support means for the visor or bill of the ball cap, they do not provide a mans to actually "shape" the visor or bill.

As such their appears to be a continuing need for new and improved cap shaping structures which may be easily inserted into the entire crown area of a ball cap while possesing sufficient structural strength to maintain crown and bill support and shape.

OBJECTS AND ADVANTAGES

Accordingly, several objects and advantages of our invention heretofore are stated.

The cap shaper is designed and formed in a manner where the washed ball cap can regain its original shape and style. The cap shaper also prevents the entire crown area of the ball cap from wrinkling and helps prevent shrinkage by holding the ball cap to its original expanded size.

When allowed to dry on the cap shaper the entire crown area of the ball cap is forced to hold or gain the shape or form of the cap shaper, which itself closely conforms to the shape of a ball cap. By inserting this semi-rigid mesh covered frame into the ball cap, the ball cap itself will dry holding this shape, easily being slid off by compressing the back of the cap shaper releasing tension off said ball cap.

By making some slight adjustments, caused by the bending or manipulating of certain areas which are conformable, the cap owner can typically shape and style a washed or wetted ball cap to their desired style, in particular the visor or bill of said ball cap.

This invention allows the cap owner to actually shape and style the entire ball cap, including the crown area and the bill of the ball cap, then leaving the ball cap to air dry.

The distinct and unique attributes of this invention are designed to overcome the disadvantages seen in the prior art mentioned. Further objects and advantages of our invention will become apparent from a consideration of the drawings and ensuing description of it.

DRAWINGS AND VIEWS

FIG. 1A is a perspective view of the left front side now including a cap properly on.

FIG. 2A is a perspective view of the right front side now including a cap properly on.

FIG. 3B is a rear elevation view now including a cap properly on.

REFERENCE NUMERALS IN DRAWINGS

| | |
|---|---|
| 12 Support Frame | 14 Interconnected Frame Projection |
| 16 Mesh | 18L–18R Bill Hooks |
| 20 Bill Brace | 22 Wall Hanging Brace |
| 24 Tension Spring | 26 Finger Holes |
| 28 split Area | 30 Direction of Pressure |
| 34 Direction to Release Pressure | 42 Crown of Ball Cap |
| 44 Bill of Ball Cap | |

1—Length is approximately 11½ inches or 29 centimeters.

2—Height is approximately 7½ inches or 19 centimeters.

3—Width is approximately 6 inches or 15 centimeters.

4—Height of Bill Brace (20) is approximately 4 inches or 10 centimeters.

5-Diameter of Finger Holes (26) is approximately 1 inch or 2½ centimeters.

6—Length of Bill Hooks (18L–18R) is approximately 5½ inches or 14 centimeters.

DETAILED DESCRIPTION

Figure 1A:
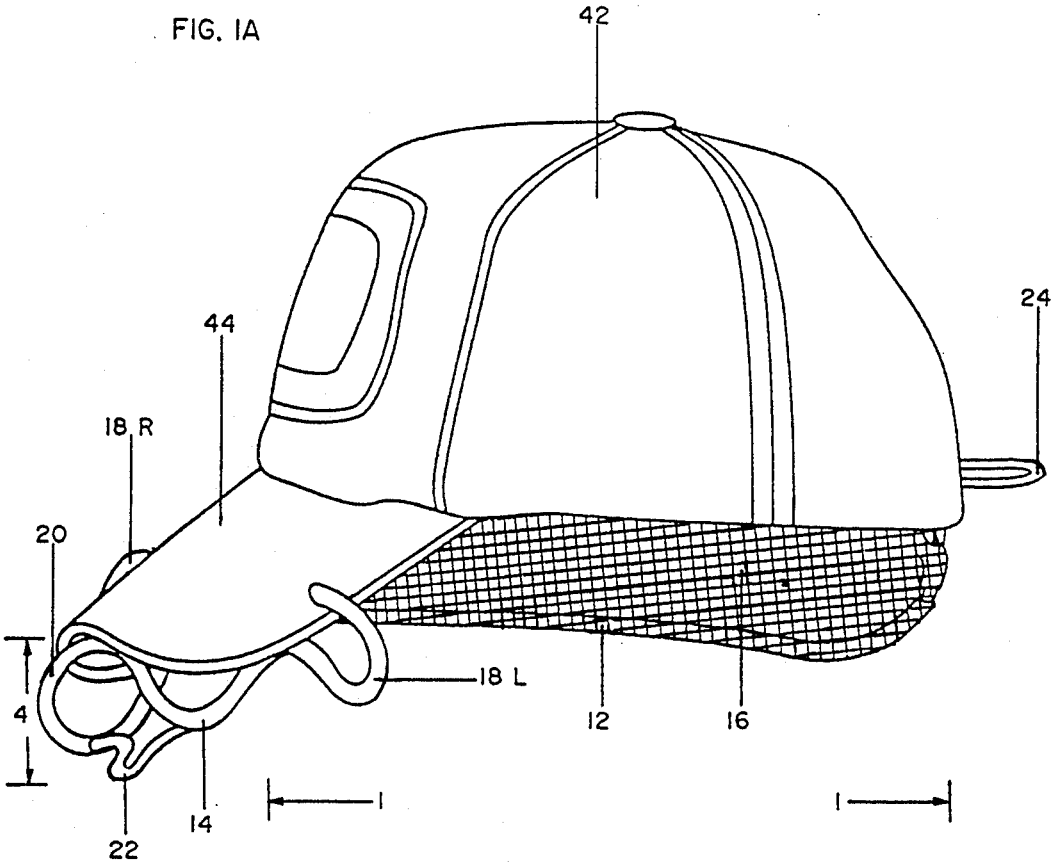
Figure 1B:
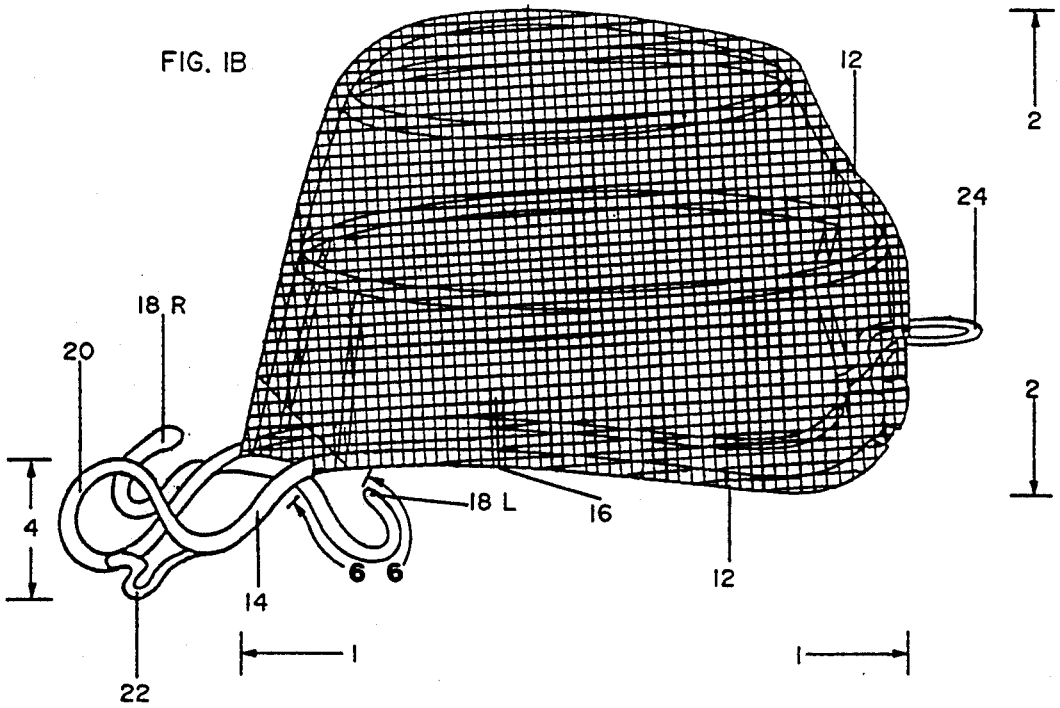
FIG. 1B is a perspective view of the left front side.

A typical embodiment of the invention is illustrated in FIGS. 1A and 1B. The cap shaper will be constructed or manufactured from a combination of polyethyleneterephthalates and wire.

The cap shaper comprises a basic support frame (12) formed and resembling the crown of ball cap (42) as shown in illustrations 1B and 2B. Support frame (12) provides the shape and base for all additional parts of the cap shaper. A number 9 or smaller polyethylene terephthalate coated wire will comprise support frame (12). Support frame (12) is bendable or conformable to shaping.

The cap shaped mesh (16) composes of a semi-rigid material consisting of polyethyleneterephthalate. Mesh (16) comprises a fine mesh or screen with openings of approximately ¼ inch or 1 centimeter or smaller. Mesh (16) overlays and is integral to all the area comprising of support frame (12) which is actually inserted into the crown of ball cap (42). Mesh (16) does not overlay or cover any of the interconnected frame projection (14) which includes the bill books (18L–18R), bill brace (20), and wall hanging brace (22). Mesh (16) also does not overlay or cover the slit area (28) as this area remains open allowing room for pension spring (24). Mesh (16) has a rounded cap shaped configuration consistant and conforming to crown of ball cap (42). FIGS. 1B, 2B, and 3B illustrates this well.

The portions of interconnected frame projection (14) ahead and in front of mesh (16) is consistant and integral to the rest of support frame (12). This portion of interconnected frame projection (14) is exposed and not overlayed by mesh (16). This exposed portion of interconnected frame projection (14) consists of a bendable or conformable wire such as polyethyleneterephthalate coated wire. This exposed area of interconnected frame projection (14) consists of bill hooks (18L–18R), bill brace (20), and wall hanging brace (22). Illustrations 1B and 2B displays these areas well.

Figure 2A:
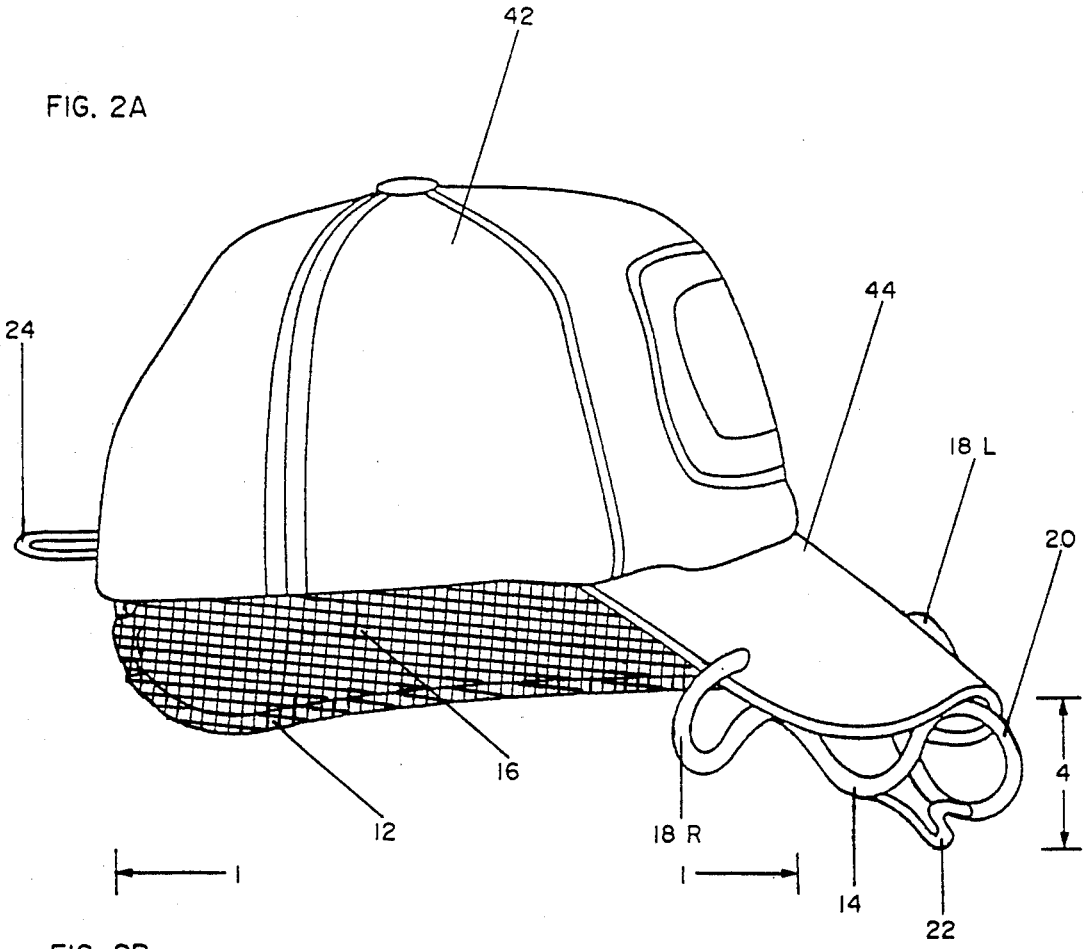
Figure 2B:
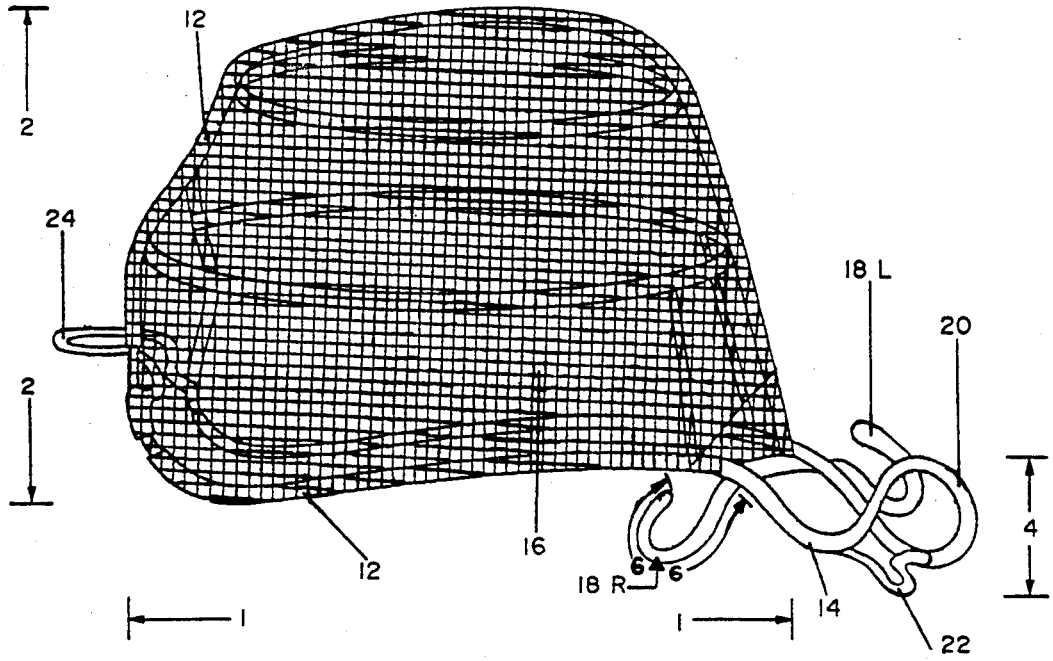
FIG. 2B is a perspective view of the right front side.

FIGS. 1A and 2A clearly shows bill hooks (18L–18R) each long enough to curve up and around their respective side of bill of ball cap (44). Approximately 5½ inches or 14 centimeters (6) for each side is sufficient, measured from point where bill hooks (18L–18R) connect to interconnected frame projections (14) on each respective side to the end of each bill hook (18L–18R). Bill hooks (18L–18R) consists of one continuous conformable wire permanently attached to interconnected frame projection (14).

Bill brace (20) consists of the forward portion of interconnected frame projection (14) which extends ahead and from under mesh (16). Bill brace connects left and right sides of the most forward portion of interconnected frame projection (14) by looping up and over in a smooth arch under bill of ball cap (44). Bill brace (20) measures approximately 4 inches or 10 centimeters high to top of curve. Bill brace (20) is well illustrated in FIGS. 1A and 1B including height (4) of bill brace (20).

The cap shaper consists of a split area (28) at the rear of the cap shaper. Split area (28) originates approximately near the top, and center of the rear area of cap shaper, and continues downward with split area (28) remaining open. At the top of split area (28) left and right side support frame (12) meet. This is all well illustrated in FIG. 3B.

Approximately centered in opening or midway down from where split area (28) originates, left and right side support frame (12) are connected by tension spring (24).

Tension spring (24) constitutes a compressed element and is constructed of a spring type material having the proper tension to spread support frame (12) and mesh (16) with a ball cap properly on.

Arrows (30) represents the direction tension spring (24) spreads and applies a constant outward pressure to each side of support frame (1) in split area (28). Arrows (34) represents the direction pressure is applied to compress tension spring (24) releasing this constant outward pressure from each side of support frame (12) in split area (28). Arrows (30 and 34) set forth the direction that tension or pressure is ultimately applied (30) to crown of ball cap (42) or released (34) from crown of ball cap (42). This is exhibited in FIGS. 3A and 3B.

Provided at the front of the cap shaper is a wall hanging brace (22) which is permanently and solidly attached to interconnected frame projection (14) at the bottom of bill brace (20) as illustrated in FIGS. 1A and 1B. Wall hanging brace (20) consists of a solid piece of wire and has a noticable bend or kink at the center.

Figure 3A:
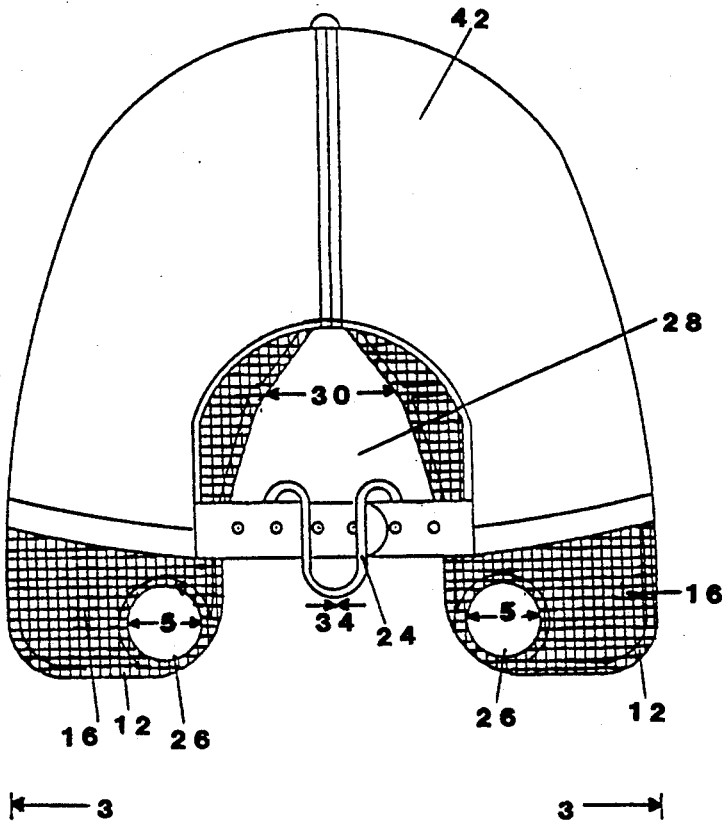
FIG. 3A is a rear elevation view.
Figure 3B:
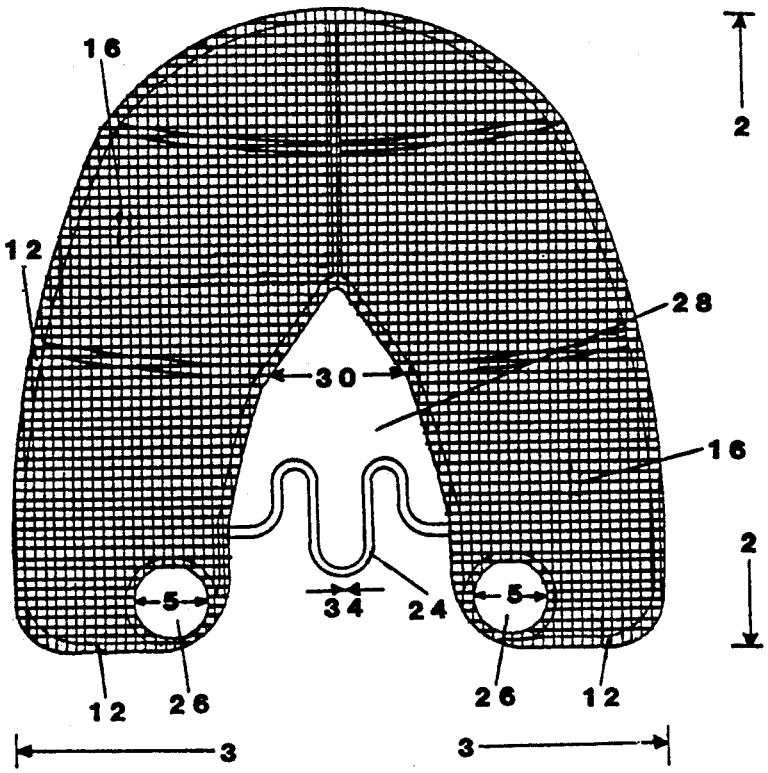

FIGS. 3A and 3B illustrates two finger holes (26) which are each approximately 1 inch or 2½ centimeters (5) in diameter. Finger holes (26) are located on each bottom side at the rear of cap shaper, and each one along side of split area (28). This is shown in FIGS. 3A and 3B.

Overall approximate dimensions of cap shaper are 11½ inches or 29 centimeters in Length (1), 7½ inches or 19 centimeters in height (2), and 6 inches or 15 centimeters in width (3) allowing for shaping, shown in all Figures.

MODE OF OPERATION

The cap shaper utilizes a cap shaped formed mesh (16) sustained by a support frame (12) as illustrated in FIGS. 1B, 2B, and 3B. As shown in FIGS. 1A, 2A, and 3A this provides a structure for supporting crown of ball cap (42) which has been placed down over cap shaper. This in turn retains and shapes entire crown of ball cap (42) while it dries inside and out due to mesh (16) openings.

Bill hooks (18L–18R), and bill brace (20) work in conjunction together to hold and shape entire bill of ball cap (44) as shown in FIGS. 1A and 2A.

FIGS. 1A and 2A shows the frontal area of interconnected frame projection (14) utilizing bill brace (20) to support bill of ball cap (44) from underneath. Bill hooks (18L–18R) hold bill of ball cap (44) snugly down and against bill brace (20). This allows the cap owner the option of flattening or curving bill of ball cap (44) while drying. This is accomplished by manually bending or conforming bill brace (20) to desired curvature. After bill of ball cap (44) is directly over and pressed down against shaped bill brace (20), bill hooks (18L–18R) are bent inward contacting and holding bill of ball cap (44). This causes bill of ball cap (44) to retain the shape or curvature of the bill brace (20) which was previously established as the desired shape by the cap owner.

FIGS. 3A and 3B depicts the rear or back of the cap shaper showing split area (28) which allows room for the expanding (30) and retracting (34) of support frame (12) and mesh (16). When tension spring (24) is retracted (34) by manually compressing at finger holes (26), the overall diameter of the support frame (12) and mesh (16) decreases. This allows for easier and more convenient placement or removal of crown of ball cap (42). When tension spring (24) pressure is applied (34) to the cap shaper, the support frame (12) and mesh (16) expands increasing in diameter. This feature distends and eliminates wrinkles through out the entire crown of ball cap (42).

FIGS. 3A and 3B illustrates two finger holes (26) which are used for gripping to compress tension spring (24). This is accomplished by grasping with either hand by inserting the thumb and first finger into holes provided and squeezing during the placement or removal of ball caps. Finger holes (26) allows easier handling of the cap shaper by providing a way to grip when compressing tension spring (24) during this phase.

Wall hanging brace (22) allows cap shaper to be hung from a nail or other suitable protrusion from a wall.

SUMMARY, RAMIFICATIONS, AND SCOPE

Thus the reader can see the cap shaper provides a highly effective and efficient device for drying and shaping ball caps.

Basically only one size cap shaper need be produced. This is due to the fact that all pliable type ball caps are themselves adjustable. The cap owner needs only to adjust each ball cap to fit semi-loosely over cap shaper while compressing tension spring (24) at finger holes (26). When released, the pressure applied by tension spring (24) distends and eliminates all remaining slack in the crown of ball cap (42).

While our above description contains many specifications, these should not be construed as limitations on the scope of the invention, but rather as an exemplification of one preferred embodiment thereof.

For example, many types and shapes of springs or compressed elements can be used in place of tension spring (24) depicted in FIGS. 3A and 3B. Other springs such as helical, coil, and leaf designs would provide the same affect. Also the exact location and placement of a particular spring would be determined by the type and style of spring selected, still providing the same result.

Exact types and combinations of materials used may allow different amounts of bracing to be used in support frame (12) as shown in FIGS. 1B, 2B, and 3B. This can only be determined by the exact selection of materials available. The particular characteristics of the materials selected such as rigidity, conformability, weight, etc. will have to be taken into account at the time of manufacture. Also a semi-rigid mesh (16) or screen containing all the proper qualities may use very little or no support frame (12) in selected areas. Although the exact amount of bracing and materials may change, the overall shape, form, and purpose of this invention will remain the same.

Also, the overall size of the openings in mesh (16) is of little significance as long as overall configuration and form is retained and finished cap shaper posseses an overall rounded and smooth form compatible to crown of ball cap (42). Mesh (16) and support frame (12) may be manufactured in one process or a combination of processes. In accordance, mesh (16) may be integral and embodied to support frame (12), or overlayed and attached to support frame (12) still providing the same purpose and result.

Accordingly, the scope of the invention should be determined not by the embodiments mentioned, but by the appended claims and their legal equivalents.

We claim:

1. A cap shaping device comprising a rigid wire support frame for supporting a mesh form thereon for receiving a crown portion of said cap, said cap including a bill portion, said support frame further including an interconnected frame projection for receiving said bill of said cap including means for retaining said bill on said projection, said bill retaining means including at least one bill hook and one bill brace.

2. The cap shaping device of claim 1 further comprising a split area in a rear portion of said mesh means, said support frame having means for reducing the circumference of said support frame at said split area to accommodate the size of a cap placed thereon.

3. The cap shaping device of claim 2 including finger holes in said frame to be grasped when reducing said circumference of said frame.

* * * * *